United States Patent [19]

Maulandi

[11] Patent Number: 4,639,561

[45] Date of Patent: Jan. 27, 1987

[54] MECHANICAL TIME DELAY MECHANISM

[75] Inventor: Aymon A. Maulandi, Cedar Rapids, Iowa

[73] Assignee: Square D Company, Palatine, Ill.

[21] Appl. No.: 683,092

[22] Filed: Dec. 18, 1984

[51] Int. Cl.[4] ..... H01H 7/00

[52] U.S. Cl. ..... 200/33 R; 335/22; 335/59

[58] Field of Search ..... 200/33 R, 33 B, 33 C; 335/59, 60, 64

[56] References Cited

U.S. PATENT DOCUMENTS 1,665,318 4/1928 Mead ..... 335/64

2,512,369 6/1950 Norris ..... 200/33 R

*Primary Examiner*—G. P. Tolin

*Assistant Examiner*—Morris Ginsburg

*Attorney, Agent, or Firm*—Mary R. Jankousky; Larry I. Golden; Richard T. Guttman

[57] ABSTRACT

A mechanical time delay mechanism is shown which provides a predetermined time delay between the movement of the moving contact blade on a circuit breaker and the activation of a switch. The control circuit design of the circuit breaker provides for tripping at one level when the breaker is in the closed position and at a second lower fault level when the circuit breaker is closing and for a predetermined number of cycles thereafter. The subject time delay mechanism activates a switch to change the tripping level from the second level to the first level at the appropriate time. The mechanism includes a pivot link assembly connected directly to the moving contact arm, a ratchet assembly, and a pivot link connecting the two. The pivot link assembly includes a set of springs to delay the movement of the link with respect to the movement of the pivot link in response to an opposing pull on the link. The pull on the link comes from the ratchet wheel which is slowed by a weighted rocker which rocks over several ratchet teeth. The switch is activated by a pin mounted on the ratchet wheel after the ratchet wheel has rotated through a predetermined angle.

13 Claims, 6 Drawing Figures

MECHANICAL TIME DELAY MECHANISM

FIELD OF THE INVENTION

This invention relates to apparatus for providing a time delay between the actuating movement of a member and the operation of a switch.

DESCRIPTION OF PRIOR ART

Systems type circuit breakers are required to withstand high fault currents for several cycles without tripping to allow other breakers downstream to clear the fault first. The withstand capability of a circuit breaker is determined with the breaker closed and latched. Usually, the circuit breaker is not able to close upon a fault equal to its withstand capability. When this is the case, it is necessary to protect the circuit breaker during the closing operation by tripping it at a level lower than its close and latch withstand capability. When the closing operation is complete, the breaker tripping level should be switched to a higher level to take advantage of the higher withstand capability of the circuit breaker. The apparatus performing the switching utilizes an electrical switch to select one of the two tripping levels available through the control circuit design. The apparatus is also required to actuate the switch a predetermined number of cycles after the circuit breaker has been closed.

Springs and hydraulic systems are known methods of providing a time delay between the movement of a first member and the resulting movement in a second member. However, these devices are too large for the present application. Neither of these known devices compatible with a relatively small movement, such as the distance traveled by the moving contact arm of a circuit breaker. Also, these devices create a time delay much longer than the multiple cycle delay necessary for a circuit breaker application.

SUMMARY OF THE INVENTION

A time delay mechanism is provided which preferably has a pivot link connected to the moving contact arm. The pivot link has a longitudinal slot in both sides. A moving pin extends through both side slots and is coupled to the pivot link to move within the side slots. A link passes through a top slot in the pivot link and is rotatably connected at one end to the moving pin.

The other end of the link is pivotably connected to a ratchet wheel which rotates about its axis as a result of the movement of the pivot link. Both the ratchet wheel and a rocker are pivotally mounted on a ratchet support. Several ratchet wheel teeth are partially positioned within a groove in the rocker. The tolerance between the teeth and rocker is such that the rocker must rock back and forth to allow the ratchet wheel to rotate.

Also mounted on the ratchet wheel is a pin which protrudes through a small semi-circular slot in the ratchet support. Upon rotation of the ratchet wheel in a given direction the pin moves within the small semi-circular slot a predetermined distance and contacts an actuator which in turn depresses a switch push button.

Although the invention is described below as adapted or use with a circuit breaker, the invention can be used in any application requiring a compact dsign, a short time delay, and actuation by a small movement.

It is an object of this invention to provide a time delay mechanism establishing a relatively short time delay between the movement of a first member in a first direction and the resulting movement of a second member.

It is a further object of this invention to provide a time delay mechanism that accommodates relatively fast movement of the first member in a second direction opposite to the first direction.

It is a further object of this invention to provide an improved time delay mechanism with a compact design.

The foregoing and other objects, features and advantages of this invention will be apparent from the following more particular description of a preferred embodiment thereof, as illustrated in the accompanying drawings.

DESCRIPTION OF THE PREFERRED EMBODIMENT

Figure 1:
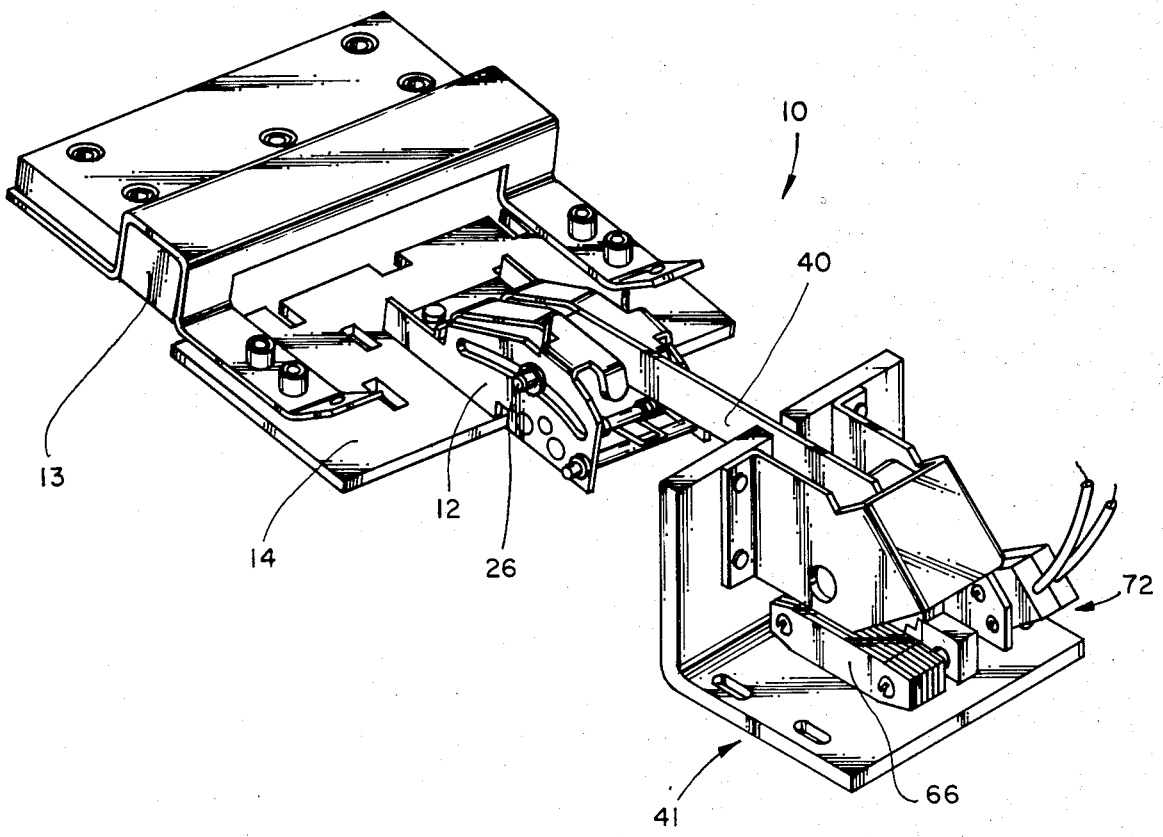
FIG. 1 is a perspective view of a time delay mechanism in accordance with the present invention.
Figure 2:
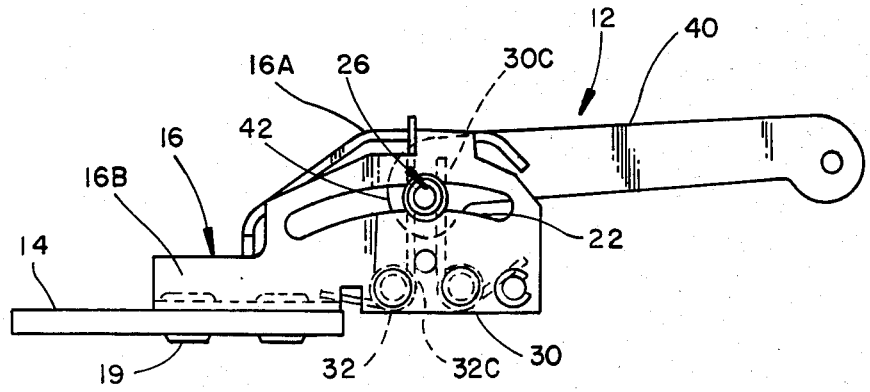
FIG. 2 is a side view of the pivot link assembly, rear blade plate, moving pin and link.
Figure 3:
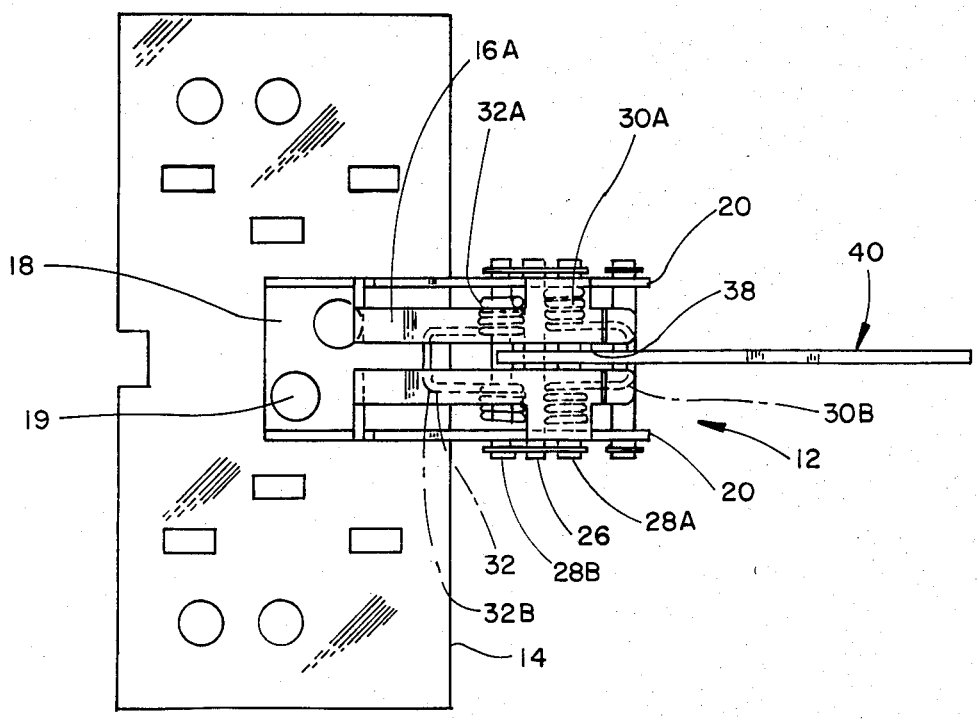
FIG. 3 is a top view of the pivot link assembly, rear blade plate, moving pin and link.

Referring now to the drawings, and particularly to FIG. 1, the time delay mechanism is indicated generally by the reference character 10. The preferred embodiment includes a pivot link assembly 12, a ratchet assembly 41 and a link 40 connecting the two. The pivot link assembly 12 includes a rear blade plate 14 which is secured to the moving contact arm of a circuit breaker such as is described in U.S. Pat. No. 4,524,339 entitled "Contact Control Arrangement for High Amperage Molded Case Circuit Breaker" issued on June 18, 1985 to F. Chabot and assigned to the assignee of the instant invention. The base 18 of the pivot link 16 is secured to the rear blade plate 14 by rivets 19. The pivot link 16 also comprises a top portion 16A and side portions 16B, having a longitudinal top slot and longitudinal side slots, 38 and 22, respectively. A moving pin 26, having a length greater than the side to side width of pivot link 16, extends through both side slots 22 and is adapted to slide within the side slots 22.

The movement of the moving pin 26 is controlled by two springs 30 and 32, each having two coil portions 30A and 32A, respectively, surrounding rivets 28A and 28B, respectively. Each of springs 30 and 32 also includes a U-shaped stationary leg 30B and 32B, respectively, located between the respective coil portions 30A and 32A and extending in opposite directions from the coil portions 30A and 32A. A movable spring leg 30C extends from each outer side of the coil portions 30A in a direction approximately perpendicular to the side slots 22 and engages one side of the moving pin 26 intermediate the moving pin and ratchet assembly 41. As the breaker closes, the moving contact arm moves the pivot link assembly 12 which is connected thereto. The movable legs 30C flex to slow the movement of the moving pin 26 and connecting link 40. Two additional movable legs 32C extent similarly from spring 32 on the opposite side of the moving pin to slow the moving pin 26 and link 40 as they move in the opposite direction during breaker opening operations.

The link 40 has two downturned ends 42, each having a bore 44. One end of the link 40 is rotatably mounted about the moving pin 26. The other end of the link 40 is pivotally connected to a ratchet wheel 48 by means of a link rivet 46 mounted on the ratchet wheel 48 and passing through the link bore 44. The link rivet 46 is located adjacent the periphery of the ratchet wheel 48 and causes the ratchet wheel to rotate about an axle 50 mounted on one side of a generally U-shaped ratchet support 56 when the link 40 moves. The ratchet support 56 includes a small semi-circular slot 80, approximately concentric with the axle 50. A pin 52 is mounted on the ratchet wheel 48 to move within the small semi-circular slot 80 as the ratchet wheel 48 rotates.

A rocker 66 pivots about a post 65 connected to the ratchet support 56. Rocker 66 includes a groove 67 partially receiving several teeth 49 of the ratchet wheel 48. The clearances between the teeth 49 and the groove 67 are such that the rocker 66 must rock back and forth as the ratchet wheel 48 rotates. Spacers 70, connected to the rocker 66 with bolts 68, add weight which slows the rotation of the ratchet wheel 48 to enable the mechanism to provide the appropriate time delay. The number and/or material of the spacers may be varied to obtain different time delays. After the ratchet wheel 48 has rotated through a predetermined angle, a switch assembly 72 is actuated which sets an appropriate tripping level for a closed circuit breaker.

Figure 4:
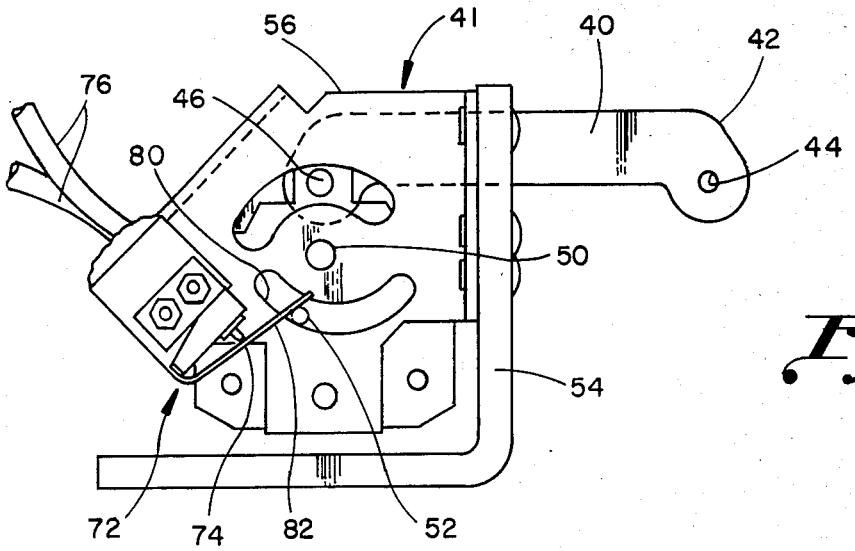
FIG. 4 is a right side view of the ratchet assembly and link.
Figure 5:
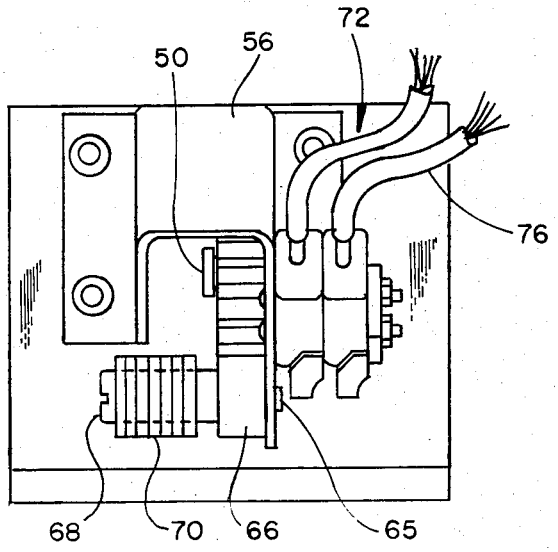
FIG. 5 is an end view of the ratchet assembly.
Figure 6:
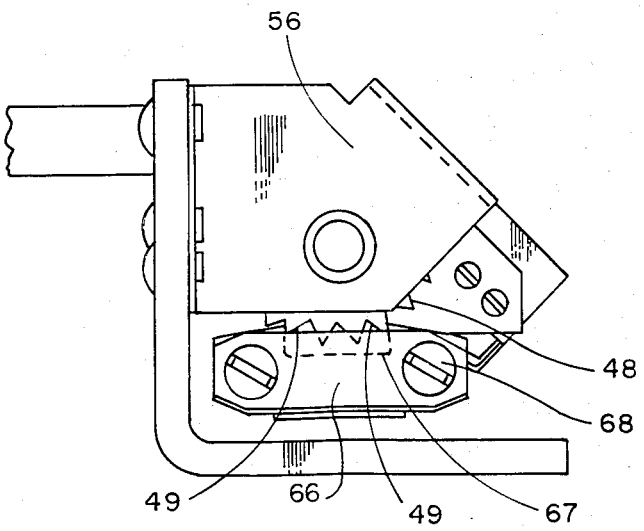
FIG. 6 is a left side view of the ratchet assembly and link.

The switch assembly 72 includes a switch button 74, leads 76 and actuator 82. The switch button 74 is not actuated while the breaker contacts are open or are in the process of closing. The actuator 82 is a semi-flexible tab canvilever supported by the switch assembly 72. When the breaker contacts are in the open position the actuator 82 is located a predetermined distance from the switch button 74 as shown in FIG. 4. As the ratchet wheel 48 rotates, pin 52 moves within the semi-circular slot 80 to contact the actuator 82, forcing it to actuate switch button 74. The time delay mechanism can also be adapted so that the pin 52 releases the actuator 82 and switch button 74 upon the closing of the circuit breaker contacts. The control circuit design must be modified to accommodate this variation.

After the circuit breaker receives the signal to close, the moving contact arm moves quickly to close the contacts, taking with it the rear plate blade 14 and the pivot link 16. Upon the sudden movement of the pivot link 16, the moving pin 26 slides within side slots 22 in a first direction. The movement of rivet 26 is first slowed by spring 30. As rivet 26 moves to the first end of side slots 22, it pulls link 40, which in turn causes ratchet wheel 48 to rotate.

Because of the close clearance between teeth 49 and rocker 66, ratchet wheel 48 does not rotate freely. As ratchet wheel 48 rotates, it must be accommodated by the back and forth pivoting of rocker 66 which slows the rotation of ratchet wheel 48. As ratchet wheel 48 rotates, pin 52 moves within the semi-circular slot 80 to activate the push button switch as described above.

While the invention has particularly been shown and described with reference to a preferred embodiment it will be understood by those skilled in the art that variations in form, construction and arrangement may be made therein without departing from the spirit and scope of the invention. All such variations are intended to be covered in the appended claims.

I claim:

1. A time delay mechanism displacing a second member after a predeterined time delay and in response to the displacement of a first member being located adjacent said mechanism, the second member also being located adjacent said mechanism, said mechanism comprising:

a link having a first end and a second end, said first end connected with the first member;

delay means for delaying movement of the link in response to displacement of the first member;

a wheel rotatably mounted about an axle, said wheel having a point spaced apart from said axle, said wheel connected at said point to the second end of said link, said wheel rotating in response to movement of said link;

slow means for slowing the rotation of said wheel; and a pin mounted on said wheel, said pin being adapted to displace the second member upon the rotation of the wheel through a predetermined angle.

2. A time delay mechanism as claimed in claim 1 wherein said delay means comprises a spring having a first end and a second end, said first end connected to said link first end, said second end connected to the first member.

3. A time delay mechanism as claimed in claim 1 wherein said wheel comprises a ratchet wheel having a series of teeth along a portion of the periphery, and said means for slowing wheel rotation comprises a rocker rotatably mounted, said rocker having a groove partially surrounding a plurality of said teeth, the distance between said teeth and said groove requiring that the rocker pivot back and forth as said ratchet wheel rotates.

4. A time delay mechanism as claimed in claim 2 wherein said spring comprises a stationary coil portion and a leg portion moving in response to movement of said link.

5. A time delay mechanism as claimed in claim 3 wherein said rocker has a groove with a first end and a second end, said rocker having a first position wherein said first groove end is positioned agianst one of said teeth and having a second position wherein said second groove end is positioned against one of said teeth, said rocker alternating between said first position and said second position upon the rotation of said ratchet wheel.

6. A time delay mechanism as claimed in claim 2, wherein said spring delays link movement in response to displacement of the first member in a first direction and in a second opposing direction.

7. A time delay mechanism as claimed in claim 1, wherein said second member comprises a switch button, said switch button being activated by the pin.

8. A time delay mechanism postponing for a predetermined length of time the displacement of a switch button in response to the movement of a member adjacent the mechanism, said mechanism comprising:

a link having a first end and a second end, the first end connected with said adjacent member to move in response to displacement of the adjacent member;

yielding means connected with the first end of said link to provide a delay between the displacement of the adjacent member and the resulting movement of the link;

a wheel connected with the second end of said link, said wheel being adapted to rotate in response to movement of the link;

braking means to slow the rotation of said wheel;

and a pin mounted on said wheel to displace a switch button upon said wheel rotating through a predetermined angle.

9. A time delay mechanism as claimed in Claim 8 wherein said yielding means comprises a resilient member connected to both the link and to the adjacent member.

10. A time delay mechanism as claimed in Claim 9 wherein said resilient member comprises spring means adapted to provide a limited amount of movement of the adjacent member relative to the link prior to driving the link.

11. A time delay mechanism mechanically coupling a first member (13) to a second member (72) which introduces a predetermined delay in the movement of the second member in response to the movement of the first member from a starting position to a specified position, said mechanism comprising:

a pivot link (12) connected fixedly to said first member;

a moving pin (26) carried by said pivot link and movable between a first position and a second position relative to said pivot link;

a connecting link (40) having a first end pivotally connected to said moving pin and an opposite end;

a ratchet support (56) connected to the second member, a ratchet wheel (48) rotatably connected to said ratchet support and having a plurality of teeth (49) along at least a portion of the periphery of said wheel, a rocker (66) having a groove (67), said rocker operably associated with said wheel such that a predetermined number of said teeth are received within said groove and rotation of said wheel causes rocking of said rocker to accommodate succeeding teeth as a part of said predetermined number whereby the speed of rotation of said wheel is limited by the movement of the rocker, said opposite end of said connecting link connected to said ratchet wheel, an actuating pin (52) connected to said ratchet wheel and movable in response to rotation of said wheel between a first position away from engagement with said second member and a second position in engagement with said second member; and biasing means for biasing said moving pin toward said first position and delaying movement of said moving pin to said second position in response to the movement of said first member to said specified position.

12. A time delay mechanism as claimed in claim 11, wherein said biasing means comprises a first spring (30) having a first end connected with said moving pin and having a second end connected with said pivot link.

13. A time delay mechanism as claimed in claim 12 additionally comprising a second spring substantially limiting the movement of the moving pin from the second position to the first position in response to the first member moving from the specified position to the starting position.

* * * * *